US007178972B2

(12) United States Patent
Owen

(10) Patent No.: US 7,178,972 B2
(45) Date of Patent: Feb. 20, 2007

(54) RECYCLED MATERIAL MIXING MACHINE

(75) Inventor: Frank I Owen, Northampton (GB)

(73) Assignee: Keanes Limited, London (GB)

( * ) Notice: Subject to any disclaimer, the term of this patent is extended or adjusted under 35 U.S.C. 154(b) by 189 days.

(21) Appl. No.: 10/483,432

(22) PCT Filed: Jul. 15, 2002

(86) PCT No.: PCT/GB02/03264

§ 371 (c)(1),
(2), (4) Date: Jan. 9, 2004

(87) PCT Pub. No.: WO03/008710

PCT Pub. Date: Jan. 30, 2003

(65) Prior Publication Data

US 2004/0170083 A1 Sep. 2, 2004

(30) Foreign Application Priority Data

Jul. 19, 2002 (GB) ..... 0117611.4

(51) Int. Cl.
*E01C 23/10* (2006.01)
*E01C 23/12* (2006.01)
*B01F 15/02* (2006.01)

(52) U.S. Cl. ..... 366/16; 366/154.1

(58) Field of Classification Search ..... 366/154.1, 366/16, 156.1, 155.1; 404/92, 91
See application file for complete search history.

(56) References Cited

U.S. PATENT DOCUMENTS 4,712,919 A * 12/1987 Bouldin ..... 366/133
5,683,208 A * 11/1997 Fage et al. ..... 404/76
5,971,600 A * 10/1999 Paterson et al. ..... 366/150.1
6,183,159 B1 * 2/2001 Hashimoto et al. ..... 404/76
6,874,973 B1 * 4/2005 Yoshida ..... 404/91

FOREIGN PATENT DOCUMENTS

| | | | |
|---|---|---|---|
| EP | 0 675 232 A1 | * | 3/1995 |
| EP | 0 716 186 | * | 12/1996 |
| EP | 0 675 232 B1 | * | 9/1999 |
| EP | 1 087 064 | * | 3/2001 |
| EP | 1186717 A1 | * | 3/2002 |
| FR | 2756769 | * | 6/1998 |
| GB | 2379894 | * | 3/2003 |
| HU | 172454 B | | 3/1978 |
| JP | 52095736 | | 8/1977 |
| WO | WO 00/77307 | * | 6/2000 |
| WO | WO 02/05978 | | 7/2001 |

OTHER PUBLICATIONS

Derwent Abstracts for WO 200077307, family of US 6874973, Derwent acc-No. 2001-041388, 2 pages.*
Hungarian Search Report, 1 page no date.

* cited by examiner

*Primary Examiner*—Tony G. Soohoo
(74) *Attorney, Agent, or Firm*—Collard & Roe, P.C.

(57) ABSTRACT

A machine for combining powder material with cohesive site-won spoil has an input hopper which provides a preliminary breaking up step. Some lime is added from a lime feeder as the material is transported to a pan mixer. During transport a rotavator acts on the cohesive material so that finely divided material enters the mixing means. Further powder ingredients can be added to the components in the pan mixer by means of a powder ingredient supply system.

2 Claims, 1 Drawing Sheet

RECYCLED MATERIAL MIXING MACHINE

CROSS REFERENCE TO RELATED APPLICATIONS

Applicants claim priority under 35 U.S.C. §119 of Great Britain Application No. 0117611.4 filed on Jul. 19, 2001. Applicants also claim priority under 35 U.S.C. §365 of PCT/GB02/03264 filed on Jul. 15, 2002. The international application under PCT article 21 (2) was published in English.

BACKGROUND OF THE INVENTION

1. Field of the Invention

The present invention relates to apparatus for combining the components of a material in building and civil engineering operations and particularly for material for use as backfill in roadwork trench excavation.

2. Description of the Related Art

A process of recycling site-won spoil to provide a material suitable for use as a backfill is described in international patent application PCT GB01/03083 filed on 9 Jul. 2001 by the present applicant. The manufacture of such a material requires the mixing of a predominantly non-granular cohesive material such as a clay soil with powder components in specific proportions. These powder components may be lime, cement and/or pulverised fly ash (PFA) also known as pulverised fuel ash.

Technical Problem

Technical problems arise in ensuring a good distribution of the powder components within the cohesive material and also in producing a material which has consistently proportioned ingredients.

The earlier application, which was unpublished at the priority date of this application, proposed a machine in which a mixing screw is used to amalgamate the components. Whilst satisfactory, it is possible for such screws to become clogged when used with cohesive materials such as heavy clay and therefore the present invention proposes an alternative approach in which the cohesive components are broken up prior to the addition of the powder ingredients.

More specifically the present invention provides a machine for recycling site-won spoil comprising predominantly non-granular cohesive material from an excavation for immediate re-use as a backfill, comprising means for receiving excavated cohesive material, means for adding a measured amount of powder material, mixing means comprising a pan mixer having a rotary blade or vane for thorough mixing the components and discharging them from the machine, and first and second means for breaking up the cohesive material before it enters the mixing means, the first breaking means being in the receiving means.

Preferably mixing is then carried out by vanes operating within a pan mixer, which is less liable to clogging. Preferably some of the lime is also added at an intermediate stage while the spoil is being broken up.

SUMMARY OF THE INVENTION

A machine for combining powder material with cohesive site-won spoil has an input hopper which provides a preliminary break up step. Some lime is added from a lime feeder as the material is transported to a pan mixer. During transport, a rotavator acts on the cohesive material so that finely divided material enters the mixing means. Further powder ingredients can be added to the components in the pan mixer by means of a powder ingredient supply system.

BRIEF DESCRIPTION OF THE DRAWINGS

In order that the invention may be well understood an embodiment thereof will now be described, by way of example only, with reference to the accompanying diagrammatic drawings, in which.

DETAILED DESCRIPTION OF THE PREFERRED EMBODIMENTS

Figure 1:
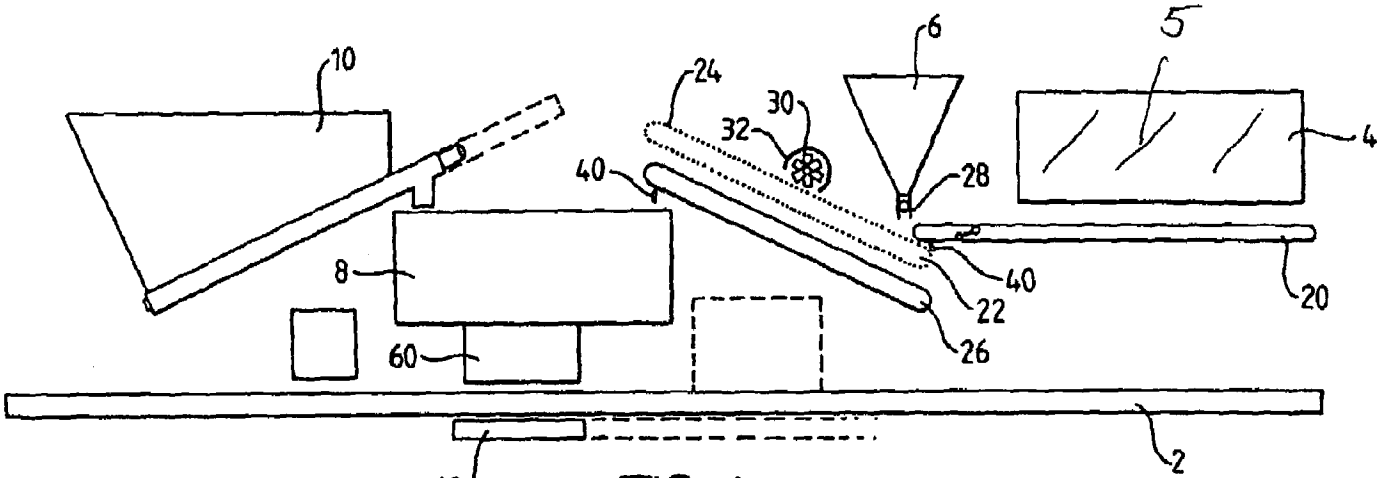
FIG. 1 is a diagrammatic sectional view of a machine.
Figure 2:
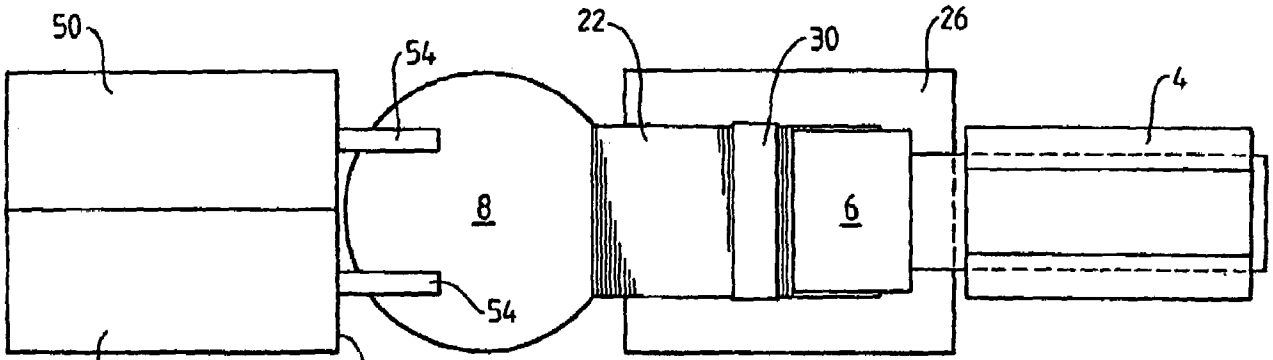
FIG. 2 is a top plan view of the machine of FIG. 1.

The machine is assembled on a platform 2 so that it can be transported. The principle elements of the machine are an input hopper 4 shown on the right hand side of FIG. 1, a lime feeder 6, a pan mixer 8 and a powder ingredient supply system 10.

The object of the machine is to deliver to the pan mixer 8 powder ingredients from the supply system 10 and clay spoil which has been broken up and pre-mixed with lime. The control of the proportions of the material is made possible by this arrangement.

The cohesive and any granular material input 4 is via a rotary sizer machine which contains inclined blades which break up the cohesive material as it passes through onto a conveyer 20 located beneath the rotary sizer hopper 4. These blades of the rotary sizer constitute the "first breaking means".

The cohesive material may be spoil from a trench excavation input directly during construction. Depending on ground conditions this may be very lumpy and the degree of water content may vary. These factors may be measured in order to determine the required proportions of powder ingredients to be added. As well as site-won spoil additional granular materials could be added through the hopper 4. The function of the input hopper is to provide a preliminary breaking up step via first breaking means 5 so that the material fed to the conveyer 20 is divided up so that it provides a significant surface area to be exposed to the lime.

The belt conveyer 20 incorporates a belt weigher, which allows the monitoring of the quantity of the cohesive material being supplied in order to maintain the correct proportions. The belt conveyer 20 delivers its load onto an upwardly inclined conveyer track 22. The conveyer track 22 has a conveying surface defined by spaced bars 24 through which sufficiently finely divided material can pass falling through this slotted conveyer 22 onto a lower conveyer belt 26.

The lime feeder 6 is a hopper positioned at the junction of the conveyer 20 and the inclined slotted conveyer 22. The lime feeder 6 contains a rotary valve 28 so as to provide a controlled feed maintaining the desired proportion of lime to the weight of cohesive material being delivered. Further lime may also be added later.

A rotavator 30 is mounted above the slotted conveyer 22 in order to be able to act on the remaining large elements of cohesive material being conveyed upwards. Because the larger lumps will tend to fall backwards along the conveyer, those reaching the upper end where they are tipped into the pan mixer 8 will be of relatively modest size, which will facilitate the final mixing process with other powder ingredients.

The rotavator 30 is adapted to be movable upwardly and downwardly relative to the surface of the slotted conveyer 22. Moving the rotavator 30 down will allow it to act on smaller sized lumps. The rotavator 30 may also need to be lifted away for cleaning purposes. The rotavator 30 is provided with a shield 32 so that all material on which it acts is directed downwardly back onto the slotted conveyer 22.

The rotavator 30 extends across the width of the slotted conveyer 22. The rotavator 30 provides the "second breaking means".

Belt scrapers 40 are provided on the undersides of the conveyers 20 and 26 to clean the belts and to prevent material being retained on the belt surfaces on the undersides of these conveyers. These scrapers are positioned so that any remaining material is either deposited onto the slotted conveyer from conveyer 20 or into the pan mixer 8 from the conveyer 26.

The powder ingredients dispenser 10 comprises two compartments 50, 52 for different powder ingredients such as lime and fly ash and/or cement. A two compartment arrangement is shown. Each compartment 50, 52 has its own auger feeder 54 which can be arranged to supply a controlled rate of feed of the powder into the pan mixer 8.

The pan mixer 8 has a rotary blade or vane arrangement which is driven by means of a motor. An outlet 60 from the pan mixer 8 is adapted to deposit the thoroughly mixed material onto a conveyer 62 through an opening in the platform 2.

The invention claimed is:

1. A machine for recycling site-won spoil comprising predominantly non-granular cohesive material from an excavation for immediate re-use as a backfill, comprising:

(a) means for receiving excavated cohesive material;

(b) first breaking means housed in said receiving means for breaking up the cohesive material;

(c) a pan mixer having a rotary blade or vane for thoroughly mixing components received in the pan mixer and for discharging said components from the pan mixer;

(d) means for transporting the material from the receiving means to the pan mixer;

(e) means for adding a measured amount of powder material to the material being transported on the transporting means; and (f) second breaking including a slotted conveyer and rotavator means for breaking up the material on the transporting means before the material enters the pan mixer, said second breaking means being outside the receiving means and having a distinct mechanism from the first breaking means.

2. A machine as claimed in claim 1, wherein the means for adding a measured amount of powder material comprises means for feeding lime onto the excavated cohesive material at an intermediate stage while the spoil is being broken up.

* * * * *